US005489186A

United States Patent [19]

Yapp et al.

[11] Patent Number: 5,489,186

[45] Date of Patent: Feb. 6, 1996

[54] HOUSING WITH RECIRCULATION CONTROL FOR USE WITH BANDED AXIAL-FLOW FANS

[75] Inventors: Martin G. Yapp, Needham; Robert V. Houten, Winchester, both of Mass.; Robert I. Hickey, Concord, N.H.

[73] Assignee: Airflow Research and Manufacturing Corp., Waltham, Mass.

[21] Appl. No.: 388,749

[22] Filed: Feb. 15, 1995

Related U.S. Application Data

[63] Continuation of Ser. No. 113,952, Aug. 30, 1993, abandoned, which is a continuation-in-part of Ser. No. 52,811, Apr. 28, 1993, Pat. No. 5,297,931, which is a continuation of Ser. No. 753,418, Aug. 30, 1991, abandoned.

[51] Int. Cl.[6] ..... F04D 29/66

[52] U.S. Cl. ..... 415/58.7; 416/189; 415/208.3

[58] Field of Search ..... 415/58.5, 58.7, 415/208.3, 211.1, 220, 223; 416/189

[56] References Cited

U.S. PATENT DOCUMENTS

| | | | |
|---|---|---|---|
| Re. 32,462 | 7/1987 | Yoshinaga et al. | 415/914 |
| 2,981,461 | 4/1961 | Murphy . | |
| 3,189,260 | 6/1965 | Ivanov | 230/120 |
| 3,285,501 | 11/1966 | McDonald . | |
| 3,307,776 | 3/1967 | White | 230/127 |
| 3,447,741 | 6/1969 | Havette et al. | 415/914 |
| 3,620,640 | 11/1971 | Lariviere | 416/189 |
| 3,627,440 | 12/1971 | Wood | 415/53 |
| 3,677,660 | 7/1972 | Taniguchi et al. | 416/189 |
| 3,842,902 | 10/1974 | Poslusny . | |
| 3,972,646 | 8/1976 | Brown et al. | 415/119 |
| 4,357,914 | 11/1982 | Hauser | 123/41.49 |
| 4,358,245 | 11/1982 | Gray . | |
| 4,370,094 | 1/1983 | Ambrosch et al. . | |
| 4,432,694 | 2/1984 | Kuroda et al. | 415/170 A |
| 4,448,573 | 5/1984 | Iranz | 415/208.3 |
| 4,548,548 | 10/1985 | Gray, III | 416/189 |
| 4,569,631 | 2/1986 | Gray, III . | |
| 4,630,993 | 12/1986 | Jensen | 415/58.7 |
| 4,673,331 | 6/1987 | Kolb | 415/58.7 |
| 4,685,513 | 8/1987 | Longhouse et al. | 165/121 |
| 4,791,520 | 12/1988 | Stegmüller . | |
| 4,871,294 | 10/1989 | Ivanor et al. | 415/58.7 |
| 4,871,298 | 10/1989 | Vera | 416/189 |
| 4,900,229 | 2/1990 | Brackett et al. . | |
| 4,981,461 | 1/1991 | Henderson . | |
| 5,000,660 | 3/1991 | Van Houten et al. . | |

FOREIGN PATENT DOCUMENTS

| | | |
|---|---|---|
| 0118769 | 9/1984 | European Pat. Off. . |
| 0122892 | 10/1984 | European Pat. Off. . |
| 0168594 | 5/1985 | European Pat. Off. . |
| 1905269 | 8/1970 | Germany . |
| 2462465 | 4/1977 | Germany . |
| 62-282198 | 8/1987 | Japan . |
| 0282198 | 12/1987 | Japan . |
| 918559 | 4/1982 | U.S.S.R. . |
| 2124303 | 2/1984 | United Kingdom . |
| WO86/01263 | 2/1986 | WIPO . |

OTHER PUBLICATIONS

A. R. Azimian et al., "Application of Recess Vanced Casing Treatment to Axial Flow Fans," *Journal of Turbomachinery*, Jan., 1990, vol. 112, pp. 145–150.

M. Ziabasharhagh et al., "Recess Vane Passive Stall Control," Presented at the International Gas Turbine and Aeroengine Congress and Exposition, Cologne, Germany, Jun. 1–4, 1992, pp. 1–10.

*Primary Examiner*—Edward K. Look
*Assistant Examiner*—Mark Sgantzos
*Attorney, Agent, or Firm*—Fish & Richardson

[57] ABSTRACT

Stationary flow control vanes positioned to encounter and redirect recirculating airflow provide a surprising combination of efficiency, low noise, and manufacturability for shrouded, banded, axial fans that are positioned in a housing. Such fan and housing combinations reduce swirl in recirculating airflow, so that the airflow entering the fan (which includes the recirculating airflow) is more ordered and fan performance is improved. The invention is particularly suited for fans that draw airflow through an upstream heat exchanger. It can also be applied to fans that blow air through a downstream heat exchanger. The invention is also suited for ducted fans.

42 Claims, 17 Drawing Sheets

HOUSING WITH RECIRCULATION CONTROL FOR USE WITH BANDED AXIAL-FLOW FANS

CROSS REFERENCE TO RELATED APPLICATIONS

This is a continuation of application Ser. No. 08/113,952, filed Aug. 30, 1993, now abandoned, which is a continuation-in-part of application Ser. No. 08/052,811, filed Apr. 28, 1993, now U.S. Pat. No. 5,297,931, which is a continuation of application Ser. No. 07/753,418, filed Aug. 30, 1991, now abandoned.

BACKGROUND OF THE INVENTION

This application relates primarily to banded, axial-flow fans that are used in combination with a housing. We use the term banded axial-flow fan to describe a fan having a hub that rotates on an axis and has blades extending in an outwardly direction (for example, generally radially) from the hub to a circular band that connects the blade tips. Blade rotation tends to force air in the general direction of the fan axis.

We use the term fan and housing combination to describe such axial flow fans in combination with a housing (e.g., a shroud or a duct) that guides airflow entering and/or leaving the fan. By shroud, we mean an airflow guide shaped and positioned to guide airflow moving between the fan and a heat exchanger. An example of a banded shrouded fan that moves air through a heat exchanger is disclosed in Gray U.S. Pat. No. 4,548,548, which is hereby incorporated by reference. By duct, we mean an elongated flow path such a those used in heat, ventilation, and air conditioning systems.

In order to compare the invention to the prior art, a figure from the '548 patent is reproduced here as FIG. 1B. See also, Longhouse, U.S. Pat. No. 4,685,513.

There have been efforts to reduce the effects of undesired airflow recirculation experienced with fan and housing combinations. Airflow recirculation can be explained as follows. The fan generates a pressure difference between the upstream side of the fan (the side from which air is drawn) and the downstream side of the fan (the side of the fan which exhausts the airflow)—i.e., pressure is higher on the downstream side than on the upstream side. Airflow recirculation is the undesired flow of air from the downstream to the upstream side of the fan, resulting from this pressure difference. For banded fans in a housing, the recirculating airflow passes through the running clearance between the housing and the band.

One way to reduce recirculation is to reduce the fan-to-housing clearance. Another way to reduce recirculation is to incorporate labyrinth seals between the fan and the housing. In some cases these methods may present difficulties in economic manufacture.

Hauser U.S. Pat. No. 4,357,914 discloses a cooling fan for use with an annular radiator having baffle rings to reduce recirculation.

SUMMARY OF THE INVENTION

The invention features certain configurations for banded, axial-flow fan and housing combinations that provide a surprising combination of efficiency, low noise, and manufacturability.

The invention generally features fan and housing combinations which include stationary flow control vanes (e.g. thin members) positioned to encounter and redirect recirculating airflow. A portion of the housing is positioned outward of the fan band, and there are running clearances between the band and the housing such that recirculating airflow moves in a pathway between the fan and the housing. According to the invention, the stationary flow control vanes are attached to the housing.

The invention provides a combination of efficiency, manufacturability and low noise. Without wishing to bind ourselves to a particular theory, such benefits may be explained at least in part as follows. Recirculating airflow generally has a swirling (rotational) component of velocity imparted either by the fan blading or by vicious effects in the recirculation passage. When reingested by the fan, this swirl causes the fan blades to operate locally at an angle of attack different from that of the main flow. Swirl also may increase inflow turbulence, which causes broadband noise, and it may lead to flow non-uniformities causing undesirable tones.

The invention is particularly suited for shrouded fans that draw airflow through an upstream heat exchanger, but the invention also can be applied to fans that blow air through a downstream heat exchanger. It is also particularly suited for ducted fans.

We have found that the invention can be practiced in two general configurations described below. While both configurations are included in a single invention, we have found that specific optimum vane geometry may be different for the two configurations, as detailed below.

The first configuration features placement of the vanes generally within the space between the fan band and the housing, although embodiments in which the vanes continue downstream of the fan band are also included within the first configuration. This configuration is best suited for applications in which there are axial packaging constraints, such as automotive applications in which a shrouded fan draws air through a heat exchanger immediately adjacent (usually upstream of) the fan.

The second configuration features placement of the vanes such that they are at least partially (or even entirely) upstream of the fan band from the perspective of the primary airflow. Such configurations are particularly suited for ducted fans, such as those in airhandlers for heating, ventilating and/or cooling buildings, where axial space is less constrained.

In preferred embodiments of the first configuration of the invention, the housing and vanes are a single injection molded plastic unit. For the second configuration, the vanes may be injection molded as part of an array that is assembled with the housing.

Preferred embodiments (particularly for automotive applications with fan/shroud/radiator combinations) are also characterized by a fan-to-housing (usually a shroud) running clearance of at least 0.25% of the fan diameter. We use the term running clearance to designate the spacing between the fan band and portions of the housing that extend around the fan band.

I. Vanes In The Band-To-Housing Gap

In preferred embodiments of the first configuration of the invention, the housing (shroud) is characterized by a reduction in radius at a location rearward of the trailing edge of the fan band. The pathway of recirculating airflow can include an inlet formed between the trailing edge of the fan band and the portion of the housing at the reduced radius. The trailing edge of the fan band is the rearwardmost portion of the band. In some embodiments, the band includes a lip that extends rearward of the blade trailing edge. Preferably, at least a portion of the vanes is positioned radially outward of the inlet to the recirculation pathway.

The above-described housing radius reduction can reduce the housing radius $R_r$ (see FIG. 2A) to a value approximately equal to, or even less than, the outer radius of the trailing edge of the fan band ($R_b$, see FIG. 2A, described below). "Approximately equal" in this context means a radius that would risk interference if the portion of the housing with the reduced radius were not offset axially from the fan band. For example, for automotive and similar applications, the two radii may differ by less than standard or nominal radial running clearance "C" (see FIG. 2A).

Also in preferred embodiments, the housing comprises a rearward housing segment extending from the radius reduction rearwardly to the rearward housing (shroud) terminus. Elongated motor supports may be attached to that rearward housing segment, extending from the housing to a centrally positioned motor mount. As the housing extends rearwardly from the location of the radius reduction, the inside diameter of the housing may increase, producing a flare to improve performance.

In yet other preferred embodiments, an inlet to the recirculation pathway is formed between the housing and the trailing edge of the band; the housing comprises a rearward portion which extends first rearwardly and then inwardly and forwardly, forming a pocket axially rearward of the inlet of the recirculation flow path. Such pockets may have a rounded back or a straight back. A portion of the vanes may extend into the pocket, and at least a portion of the vanes is axially rearward of the trailing edge of the band. Also, the vanes may be characterized by a reduction in radius at a position axially rearward of the trailing edge of the fan band.

Also in some embodiments, the recirculating airflow pathway includes an outlet formed between the housing and an outwardly flaring segment of the leading edge of the fan band. Advantages may be achieved according to the invention with other geometries that do not include this detail, however.

The vanes may be straight (radial or non-radial) taken in a section in a plane normal to the fan axis. Alternatively, the vanes may be curved taken in a section in a plane normal to the fan axis.

II. Vanes Upstream Of The Fan Band

We turn now to a second configuration of the invention in which the vanes are at least partially upstream of the fan band.

In some embodiments of the second configuration of the invention, the space through which airflow recirculates comprises a restriction upstream (from the perspective of recirculating airflow) of the vanes. Without wishing to be bound to or limited by a specific theory, we believe improved performance from this configuration may result, at least in part, because the restriction causes the airflow to jet into the spaces between the vanes, rather than to be deflected radially or tangentially. Also preferably, the band comprises a lip flaring outwardly to establish the above described restriction. (This embodiment of the invention also has application in some embodiments of the first configuration of the invention, e.g. in the embodiment of FIG. 5B where the inlet to the recirculation path is the restriction.)

The vanes may be part of a single injection molded plastic piece. For example, the vanes may be arranged in an array whose inward tips are connected by an inner ring. The inner ring gives structural rigidity to the vane assembly, which allows the housing to be formed around the vane assembly.

The vanes may be molded in various configurations that better match the direction of incoming recirculating airflow. These configurations may be particularly beneficial in fans producing a relatively low pressure rise at some segment of the duty cycle. For example, the vanes may be molded so that the end faces of the vanes are beveled (preferably at least 20° and most preferably at least 30) so that the high pressure side surfaces extend slightly further upstream (from the perspective of recirculation airflow) than the low pressure side surfaces. The sides of the vanes can also be hooked so that the high pressure side surfaces are concave near the upstream end of the vanes (e.g. so that the radius of the concave portion is between 0.1 S and 1.0 S, where S is the spacing between adjacent vanes). The vanes may be angled slightly from purely radial, with the radially inward tip being inclined towards recirculation flow impinging on the vanes. The vanes (or at least the high pressure side of the vanes, with the low pressure side being straight) may be curved in a planar section normal to the fan axis (e.g., the section may be cylindrical with a radius of curvature of between 0.15 D and 0.3 D) .

Other features and advantages of the invention will be apparent from the following description of preferred embodiments and from the claims.

BRIEF DESCRIPTION OF THE DRAWINGS

I. Vanes In The Band-To-Housing Gap

II. Vanes Upstream Of The Fan Band

Figure 10:
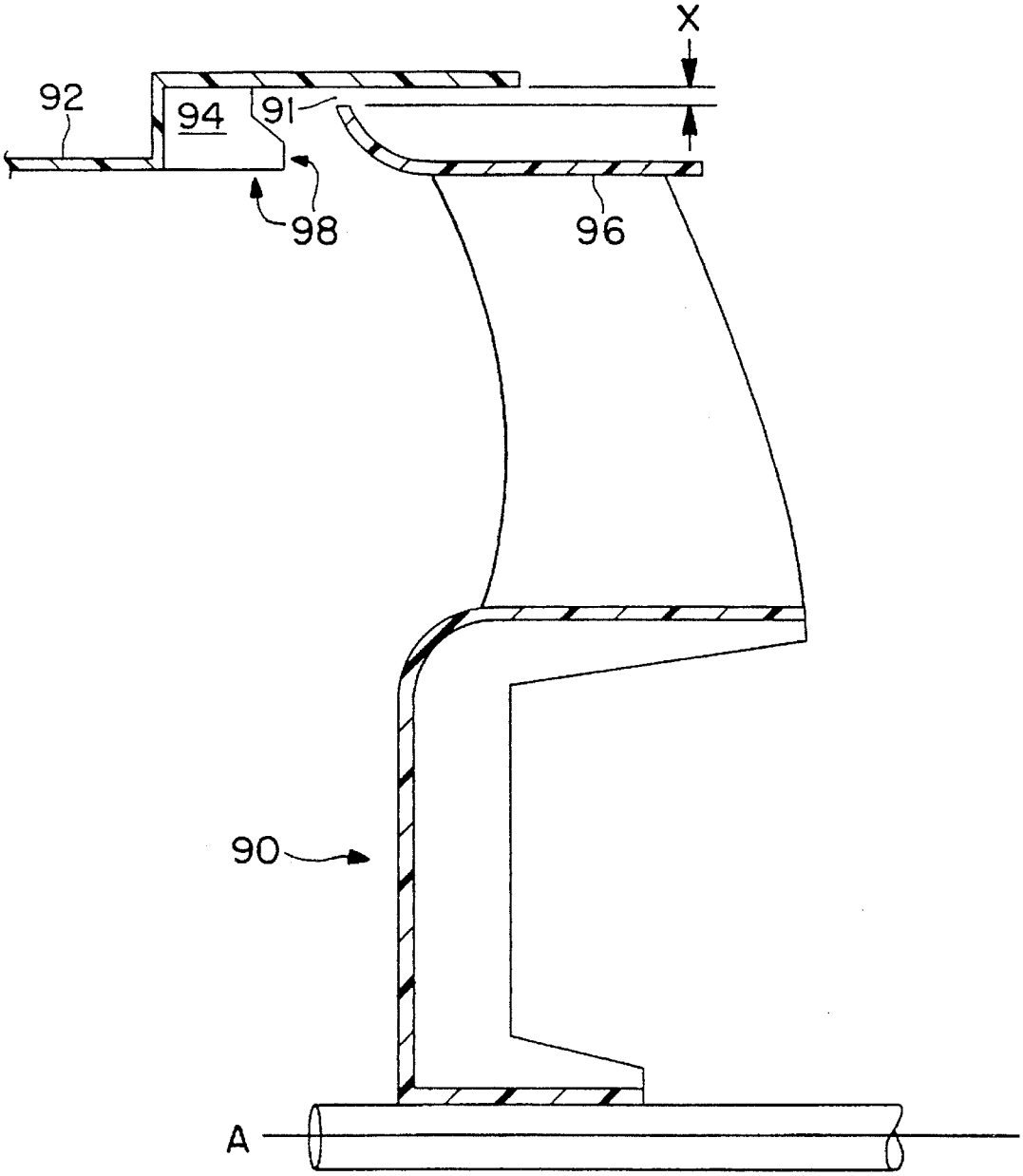

FIG. 10 is a side view in section of a fan and duct showing vanes upstream of the fan band.

Figure 11:
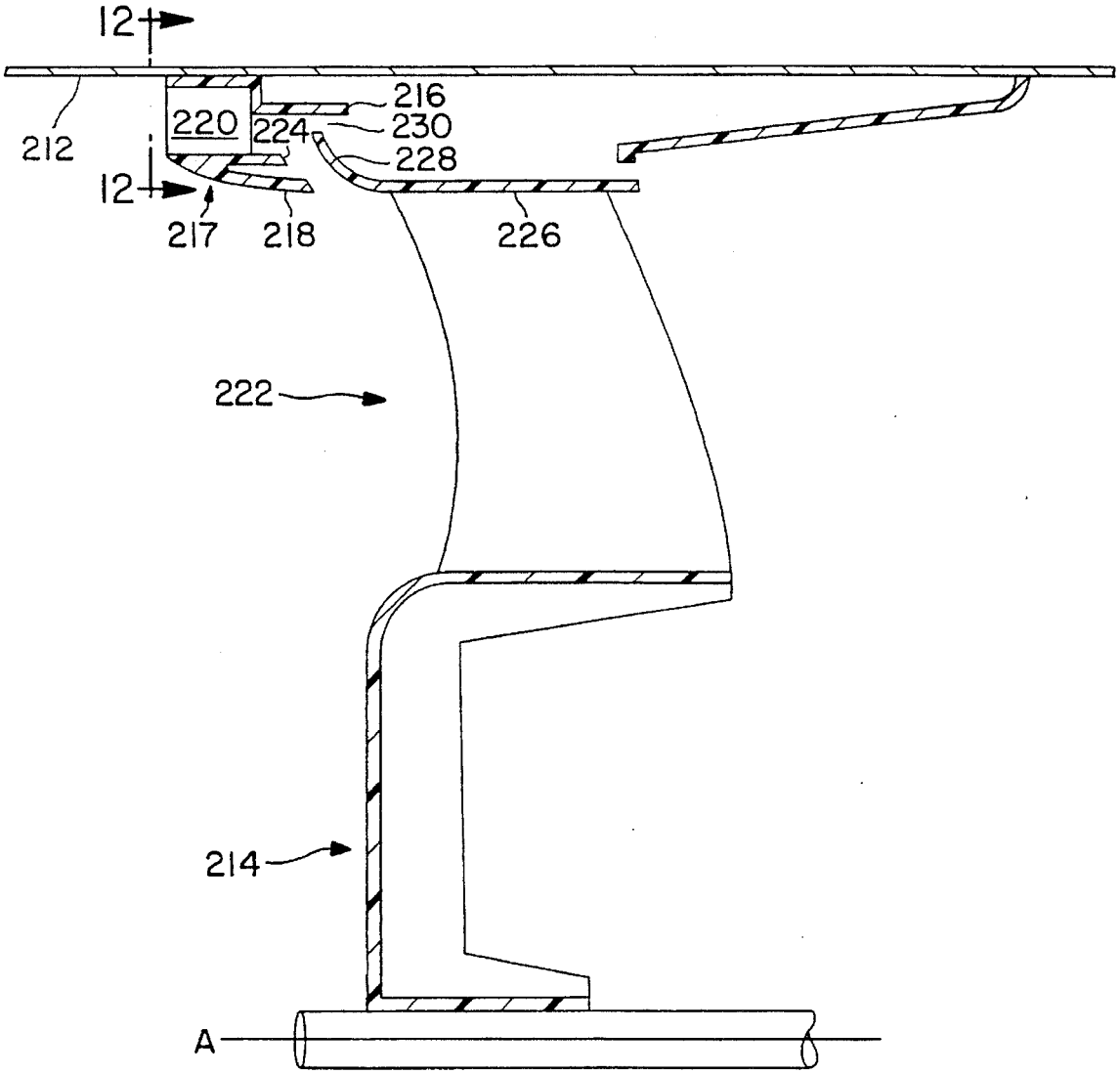

FIGS. 11 is a side view in section of a ducted, banded fan being used with a dual-ring vane assembly.

Figure 12:
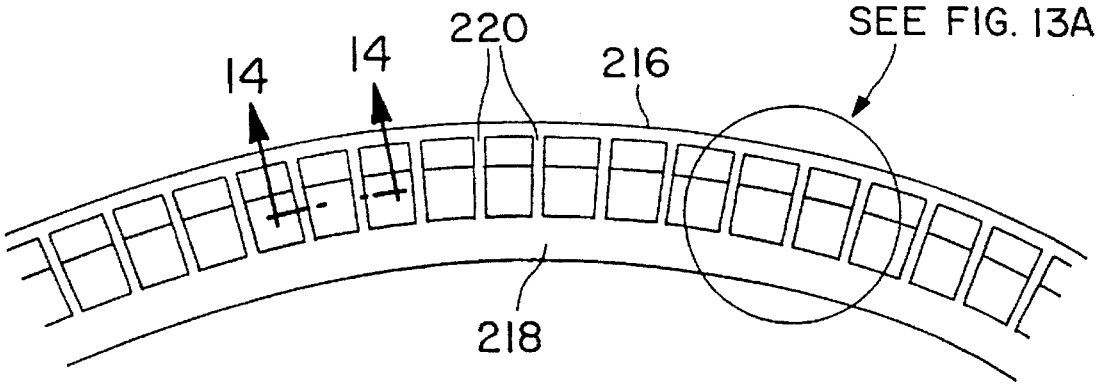
Figure 13A:
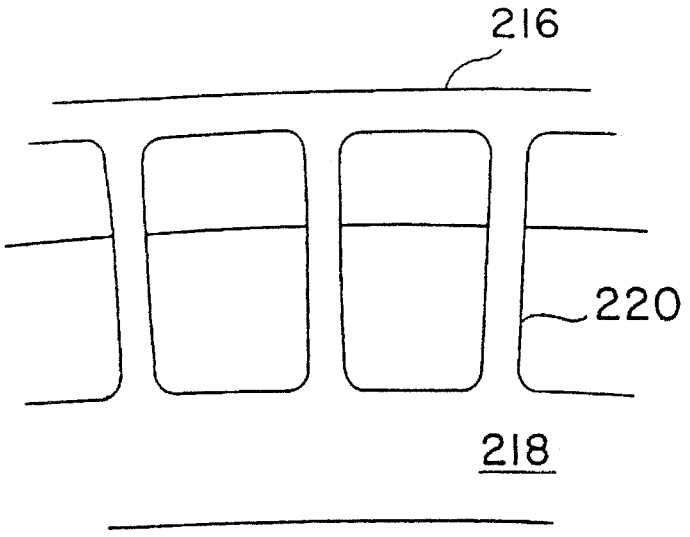
Figure 13B:
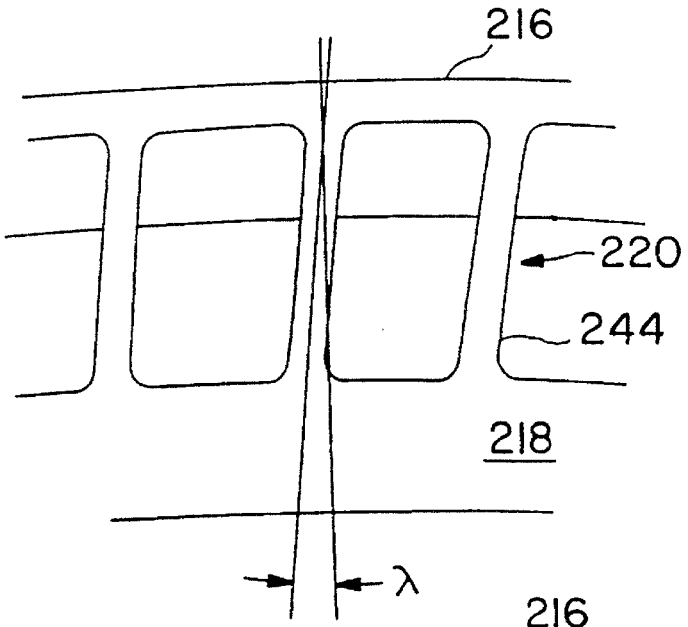
Figure 13C:
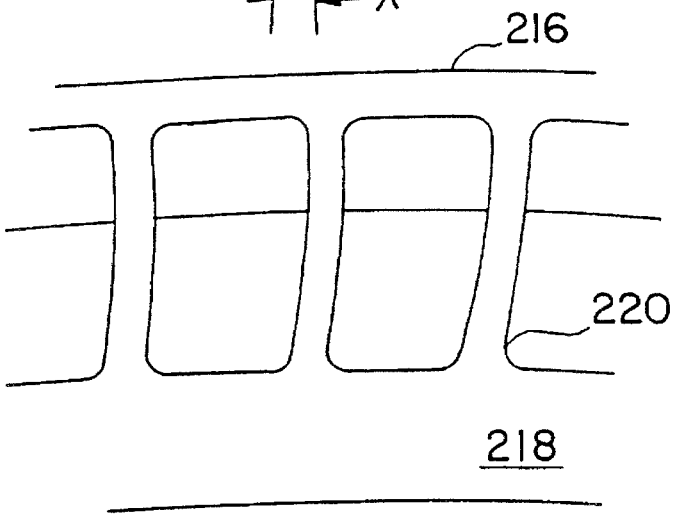

FIG. 12 is an end view of the vanes taken along 12—12 of FIG. 11, showing only a portion of the vanes. FIG. 13A is a close-up of the circled portion of FIG. 12. FIGS. 13B and 13C are similar views of alternative configurations.

Figure 14A:
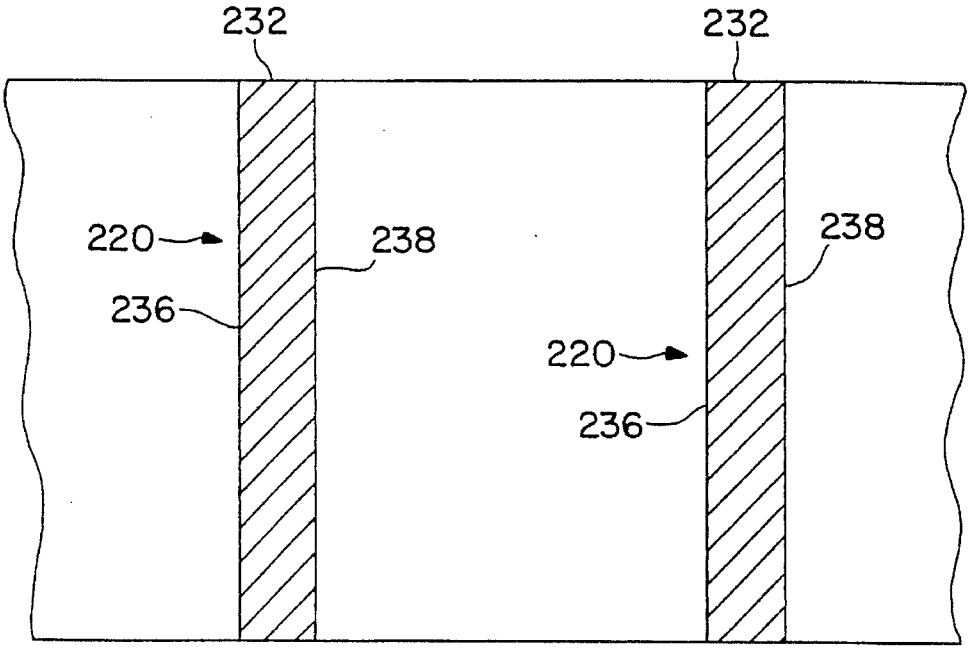
Figure 14B:
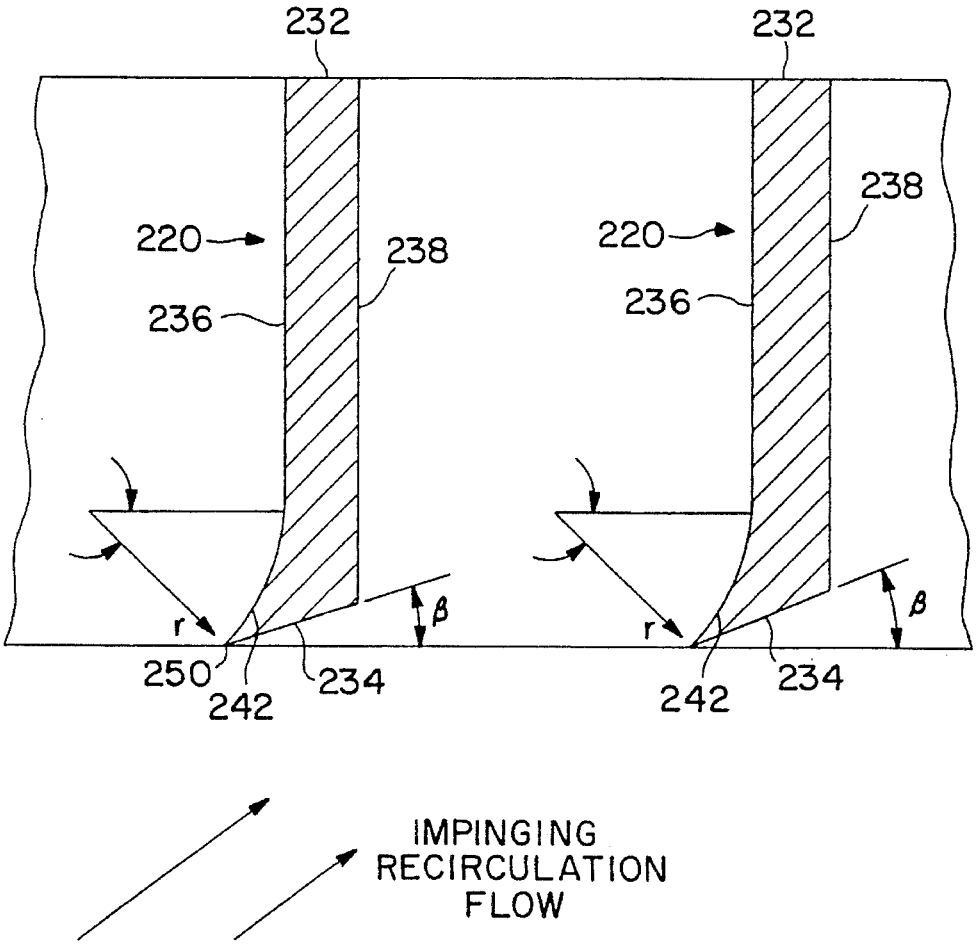

FIG. 14A is a sectional view taken along 14A—14A of FIG. 12 showing square leading edge details for a pair of vanes. FIG. 14B is a section of an alternative vane configuration.

Figure 15:
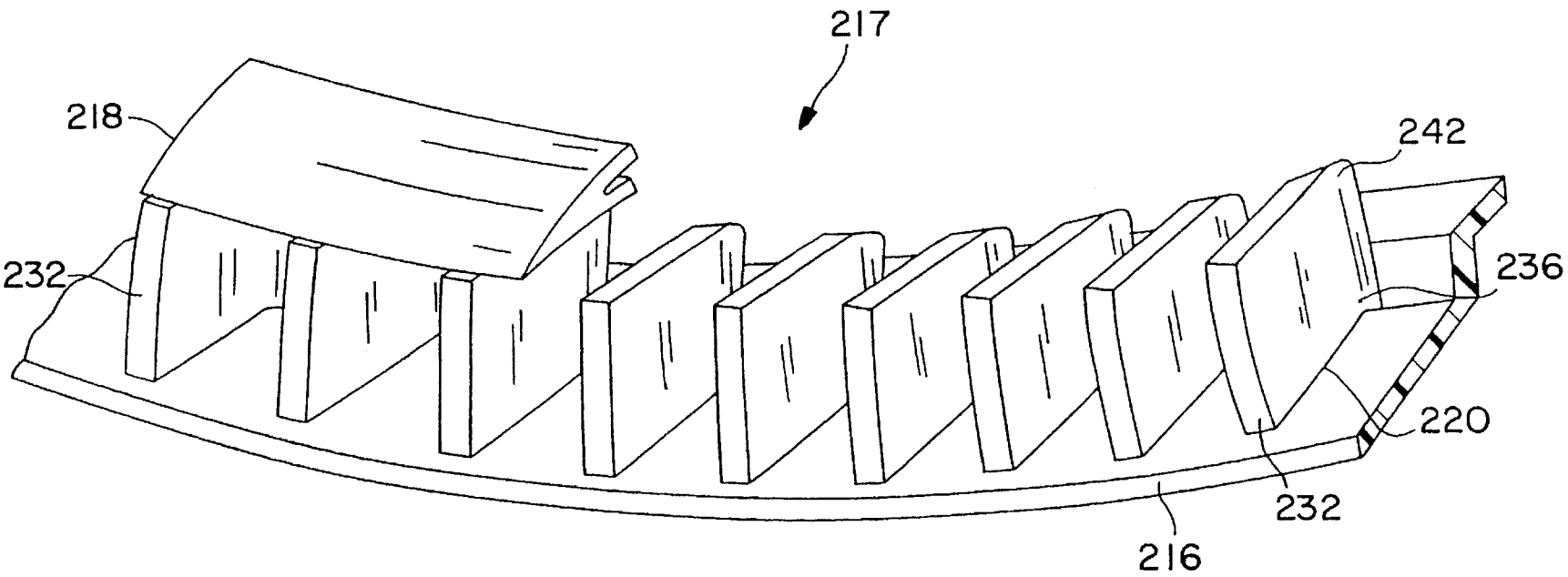

FIG. 15 is perspective view of one particular vane embodiment according to the invention.

DESCRIPTION OF THE PREFERRED EMBODIMENTS

We will describe embodiments of the two configurations of the invention separately.

Figure 4A:
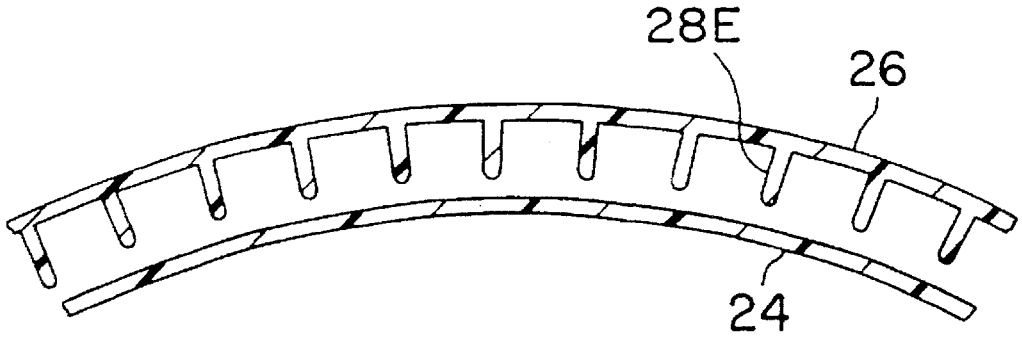
FIGS. 4A–4C are diagrammatic representations of arrays of vanes according to the invention in circumferential view.
Figure 4B:
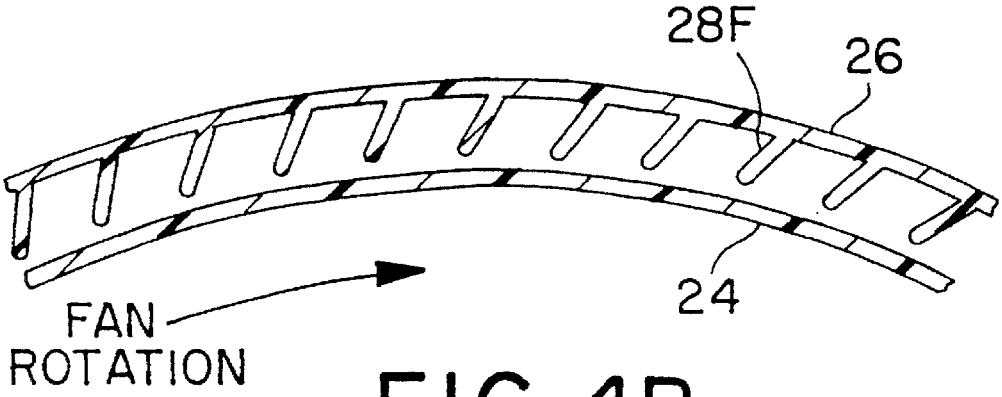
Figure 4C:
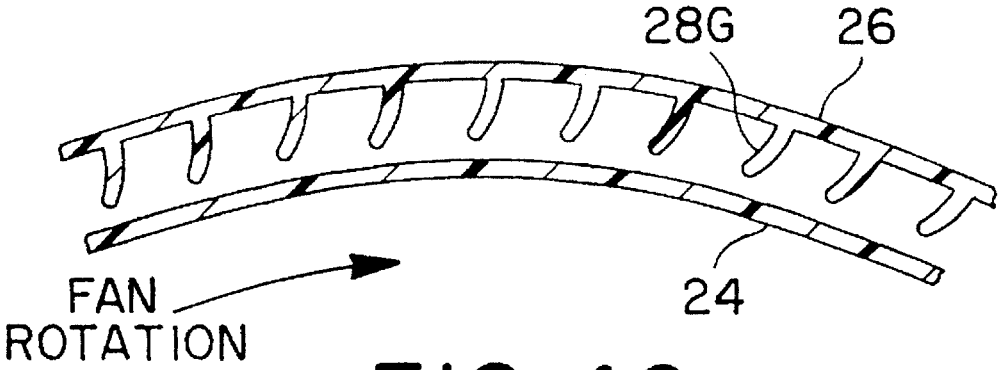

I. Vanes in Gap Between Housing and Fan Band In FIG. 1A, fan 20 is positioned in shroud 26 to pull air through heat exchanger 21. Axis A is the fan's rotational axis. Fan 20 has a band 24 connecting the outer tips of blades 22. Band 24 terminates at its upstream edge in a lip 30. Vanes 28 are attached to shroud 26. FIGS. 4A–4C are sectional views (perpendicular to the fan axis) of arrays of vanes 28, showing the alternative configurations of the vanes. The sections are taken looking rearwardly along the fan axis, and the direction of fan rotation is clockwise. In FIG. 4A, vanes 28E are radial. In FIG. 4B, vanes 28F are straight, and they are angled from the radial direction. In FIG. 4C, vanes 28G are curved to receive airflow having a rotational component in the direction of fan rotation. Advantageously, the design of vanes 28 and shroud 26 permits the entire shroud and the vanes to be injection molded as a single unit. The spacing between vanes 28 is selected to remove swirl without excessively blocking airflow. In typical applications there will be more than 10 and less than 1000 (e.g., 30–200) of these vanes, although there may be fewer or more in specific applications.

Figure 1A:
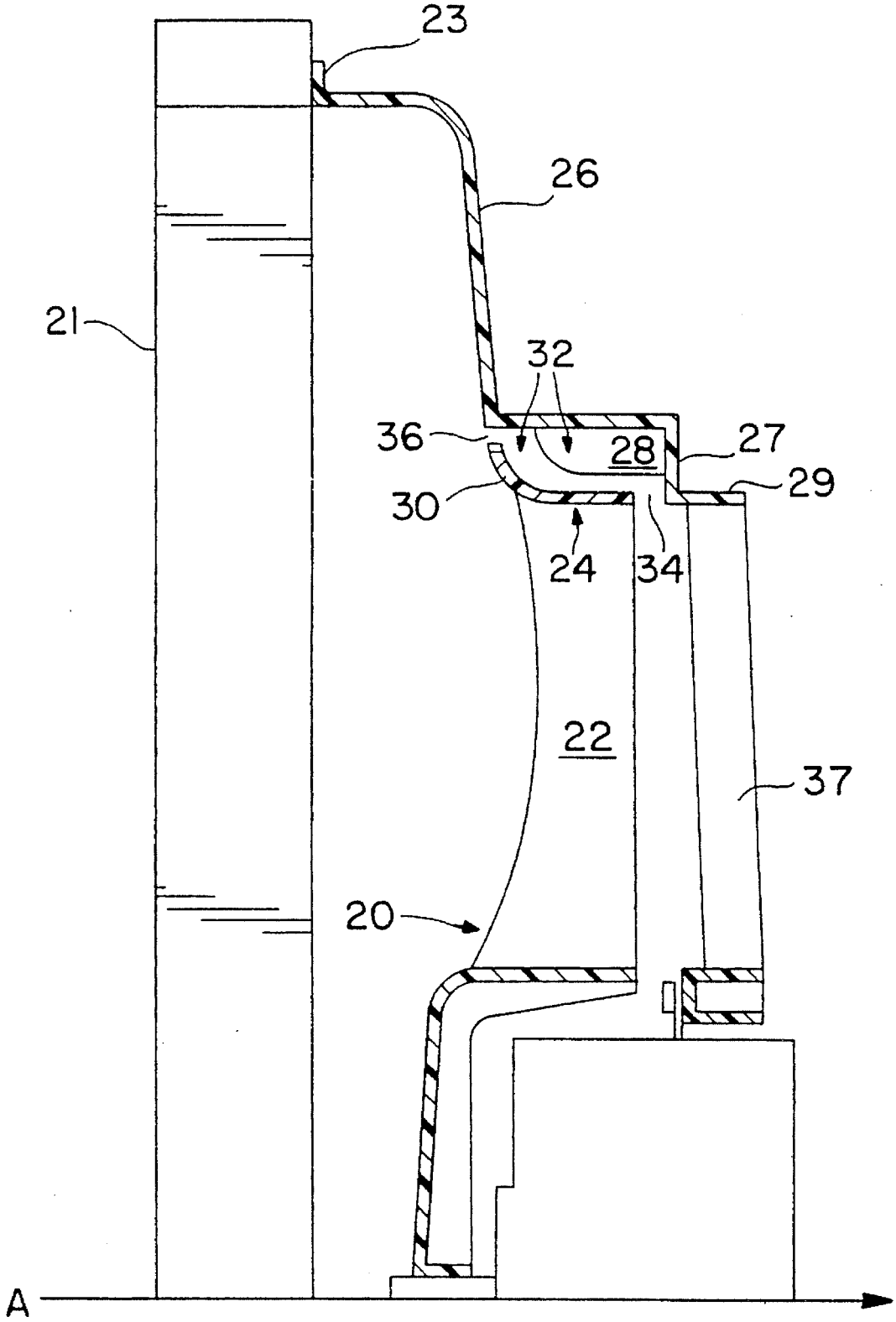
FIG. 1A is a side view in section of a fan and shroud according to the invention, including an upstream heat exchanger.
Figure 2A:
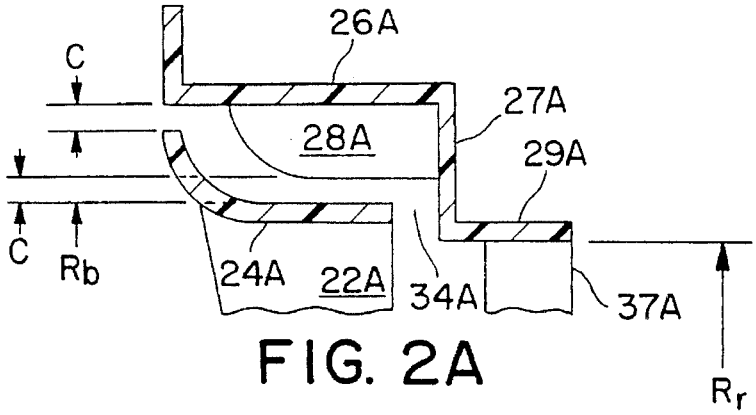
FIGS. 2A–2D are views in section of portions of fan and shroud combinations according to the invention, showing alternative configurations of the shroud radius reduction.

Fan 20 and shroud 26 are designed with running clearances to avoid interference between band 24 and shroud 26. Shroud 26 has a radius reduction rearward of band 24 (formed by shroud segments 27 and 29), which reduces the shroud radius ($R_r$) to less than the outer radius ($R_b$) of band 24 at its trailing edge, plus clearance "C". FIG. 2A illustrates $R_r$, $R_b$ and $R_c$ on a fan and housing similar to that shown in FIG. 1A.

Motor supports (one shown as 37 in FIG. 1A) are attached to shroud segment 29. Shroud 26 is mounted to radiator 21 by mounts 23.

Figure 1B:
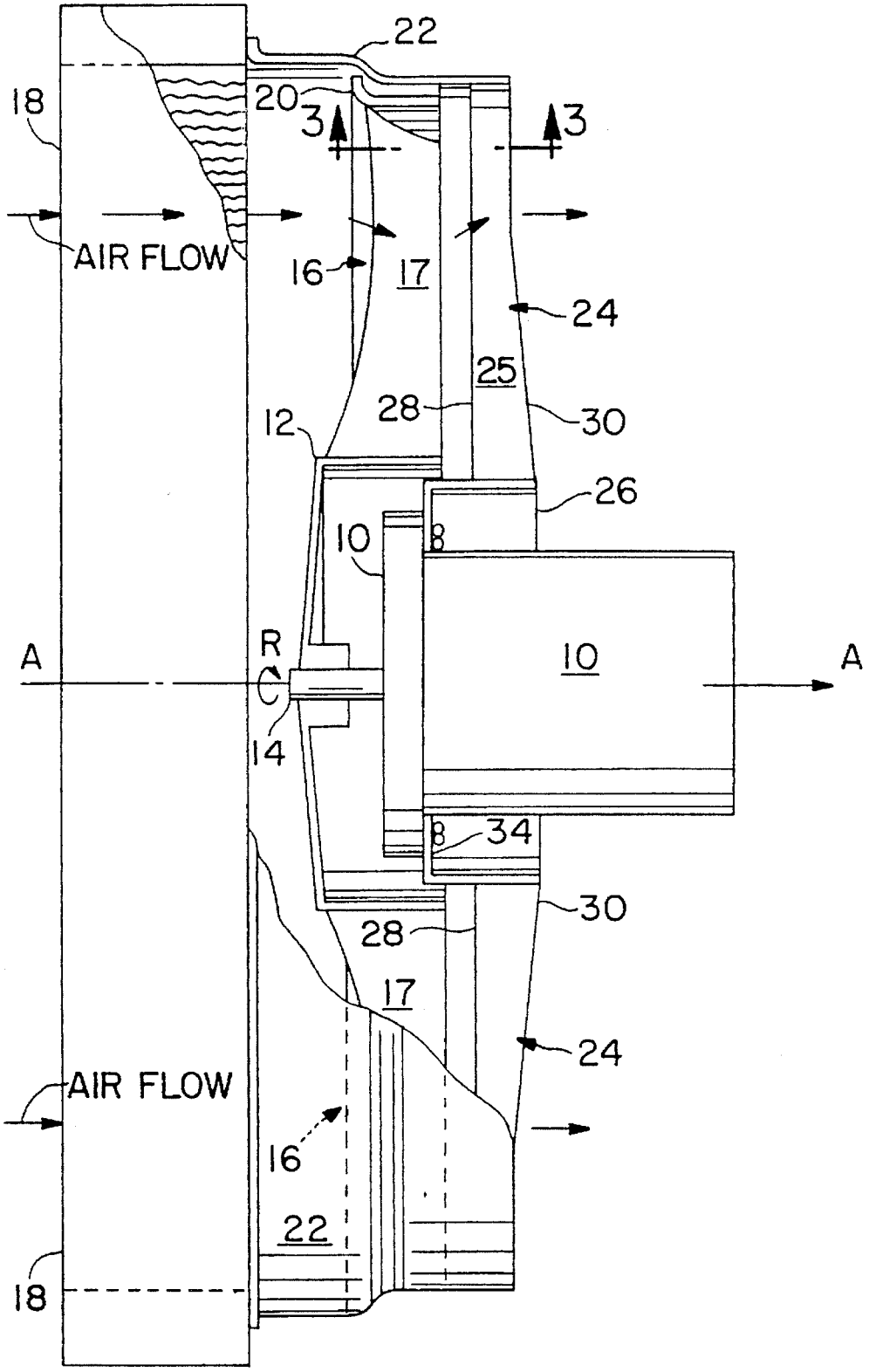
FIG. 1B (PRIOR ART)
FIG. 1B shows a prior art fan.

For comparative purposes, we include FIG. 1B which is a figure reproduced from Gray, U.S. Pat. No. 4,548,548. Note that the recirculation flow path between the shroud and the band does not include vanes. Moreover, the radius of the shroud is relatively constant rearward of the lip of the band, at a value that must provide clearance between the band and the shroud. The radius of the fan band $R_b$, the radius of the shroud after the reduction $R_r$, and clearance "C" are shown in FIG. 2A, discussed below.

The operation of the invention can be described as follows. Recirculating airflow enters the inlet between band 24 and the shroud radius reduction formed by segments 27 and 29. The airflow turns to travel in space 32 and encounters vanes 28 whereby rotational velocity is reduced. The airflow exits the recirculation path through outlet 36, which is formed between the upstream edge of lip 30 and shroud 26.

Preferably, the widths of inlet 34 and outlet 36 are as narrow as manufacturing processes permit to minimize leakage and resulting lost energy. In practice, for typical automotive applications, the width of inlet 34 may be about 0.04 D (where D=the fan diameter) or less, and the width of outlet 36 may be 0.02 D or less.

FIGS. 2A–2D are diagrammatic representations of details of fan/shroud combinations that are similar to the one shown in FIG. 1A, with differing inlets to the recirculation flow path space. In each of those figures, fan blades terminate in a similar band. Vanes are included in the space between the fan band and the shroud. The shroud includes a radius reduction rearward of the trailing edge of the fan band. The specific designs of the shrouds differ in these radius reductions, thus providing different inlets to the recirculation flow path. In view of those similarities, the embodiments of FIGS. 2A–2D will only be described to highlight the differences among those embodiments. Features in FIGS. 2A–2D are numbered with numbers corresponding to those used in FIGS. 1A.

In FIG. 2A, the shroud radius reduction segments 27A and 29A are rearward of the trailing edge of band 24A. The inner radius of segment 29A is less than the outer radius of the trailing edge of band 24A.

Figure 2B:
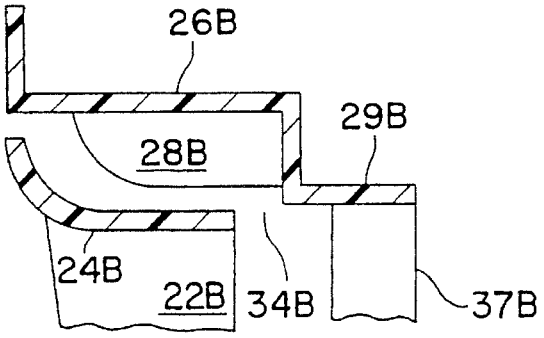

In FIG. 2B, shroud segment 29B has an inner radius slightly larger than the outer radius of the trailing edge of band 24B.

Figure 2C:
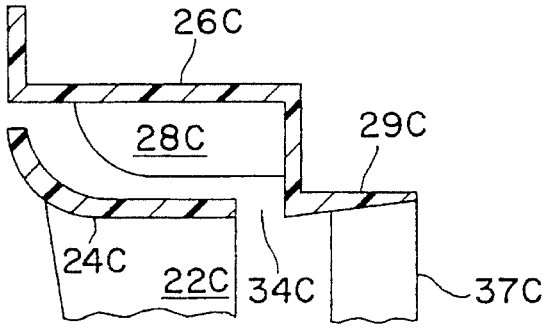

In FIG. 2C, segment 29C has a radius approximately equal to that of the fan band. Segment 26C flares outwardly, to optimize performance in some applications. The thickness of the shroud may decrease with rearward extent, so that the outer shroud diameter in this segment flares less or is generally cylindrical.

Figure 2D:
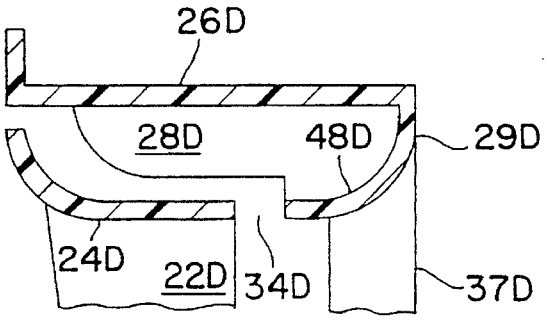

In FIG. 2D, segment 29D is rounded to form a pocket 48D. This geometry allows a large amount of flare to be used on an injection moldable part. Vanes 28D extend into the pocket.

Figure 3A:
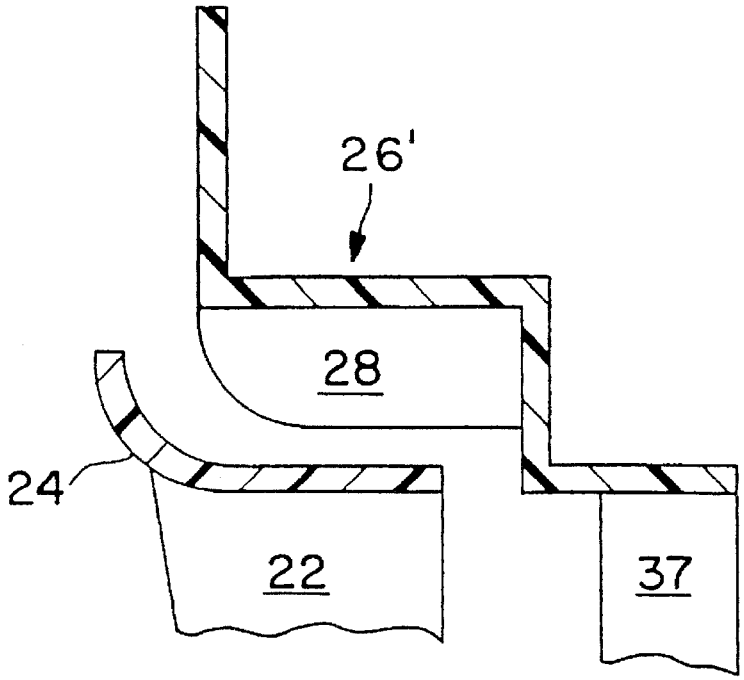
FIGS. 3A and 3B are sections of fan and shroud combinations showing variations in shroud design upstream of the vanes.
Figure 3B:
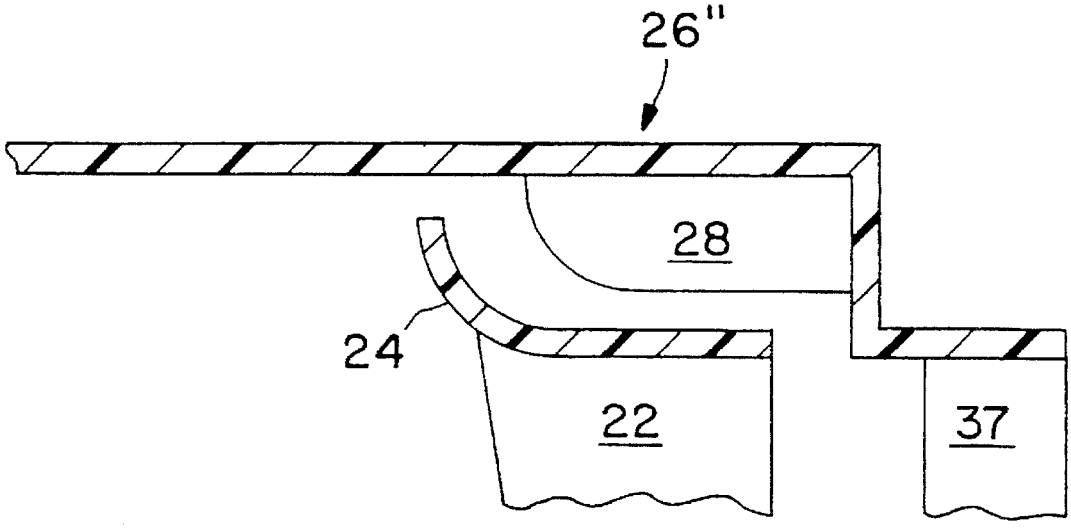

FIGS. 3A and 3B are sections of fan and housing combinations that are similar to the fan of FIG. 1A, except in the configuration of shroud 26' and 26" upstream of the fan. In both figures, fan blade 22 terminates in a band 24. Vanes 28 are positioned in the recirculation flow path. Motor supports 37 extend from a downstream extension of the shroud. Unlike the fan and housing depicted in FIG. 1A, in FIG. 3A, a restriction is not formed between the band 24' and shroud 26'. In FIG. 3B, the radius of shroud segment 26" is essentially constant, and a restriction is formed between band 24 and shroud 26". Both configurations are within the spirit of the invention.

Figure 5A:
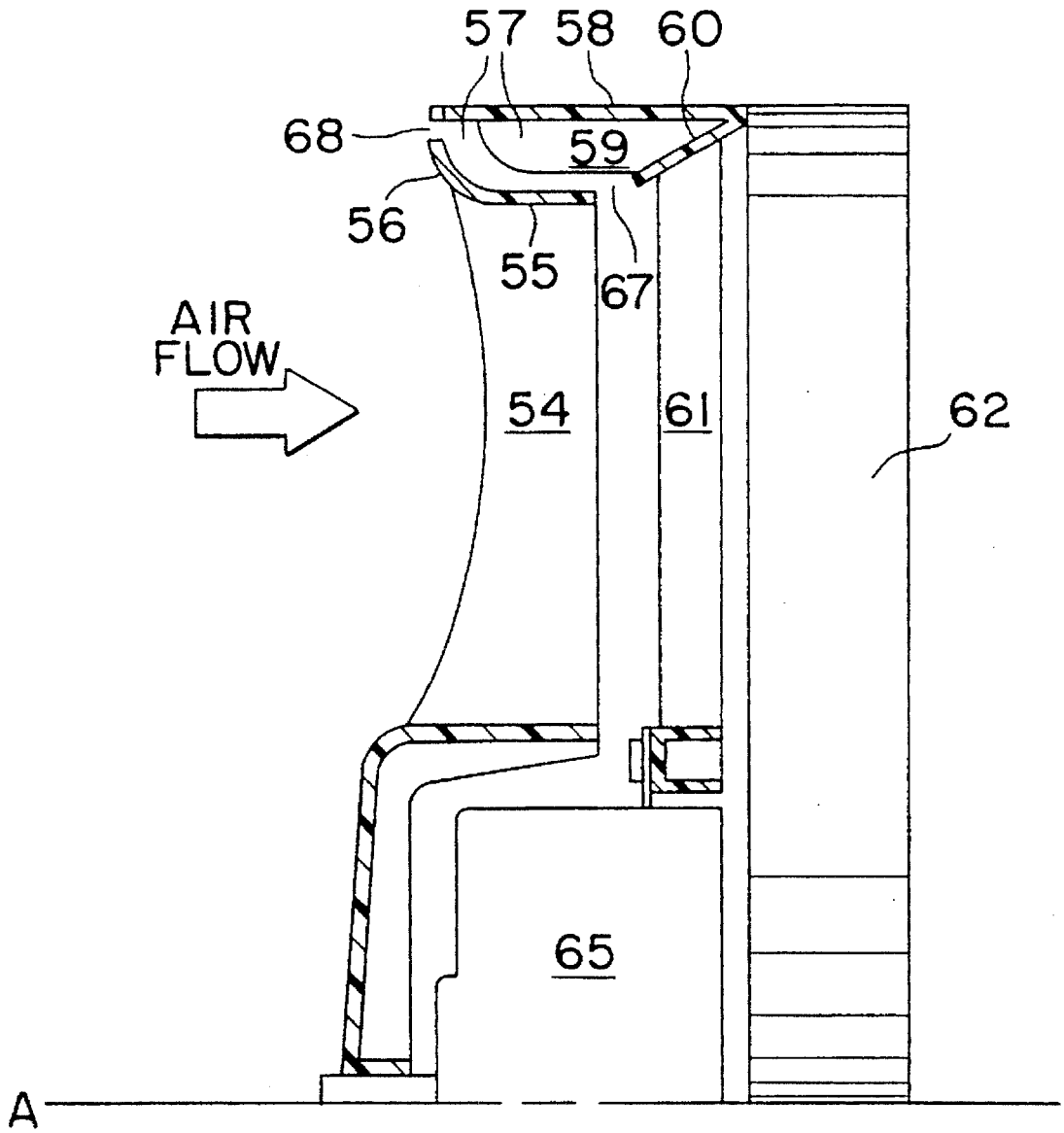
FIGS. 5A and 5B are side views, in section, of other fan/shroud combinations according to the invention, in which a heat exchanger is downstream of the fan.
Figure 5B:
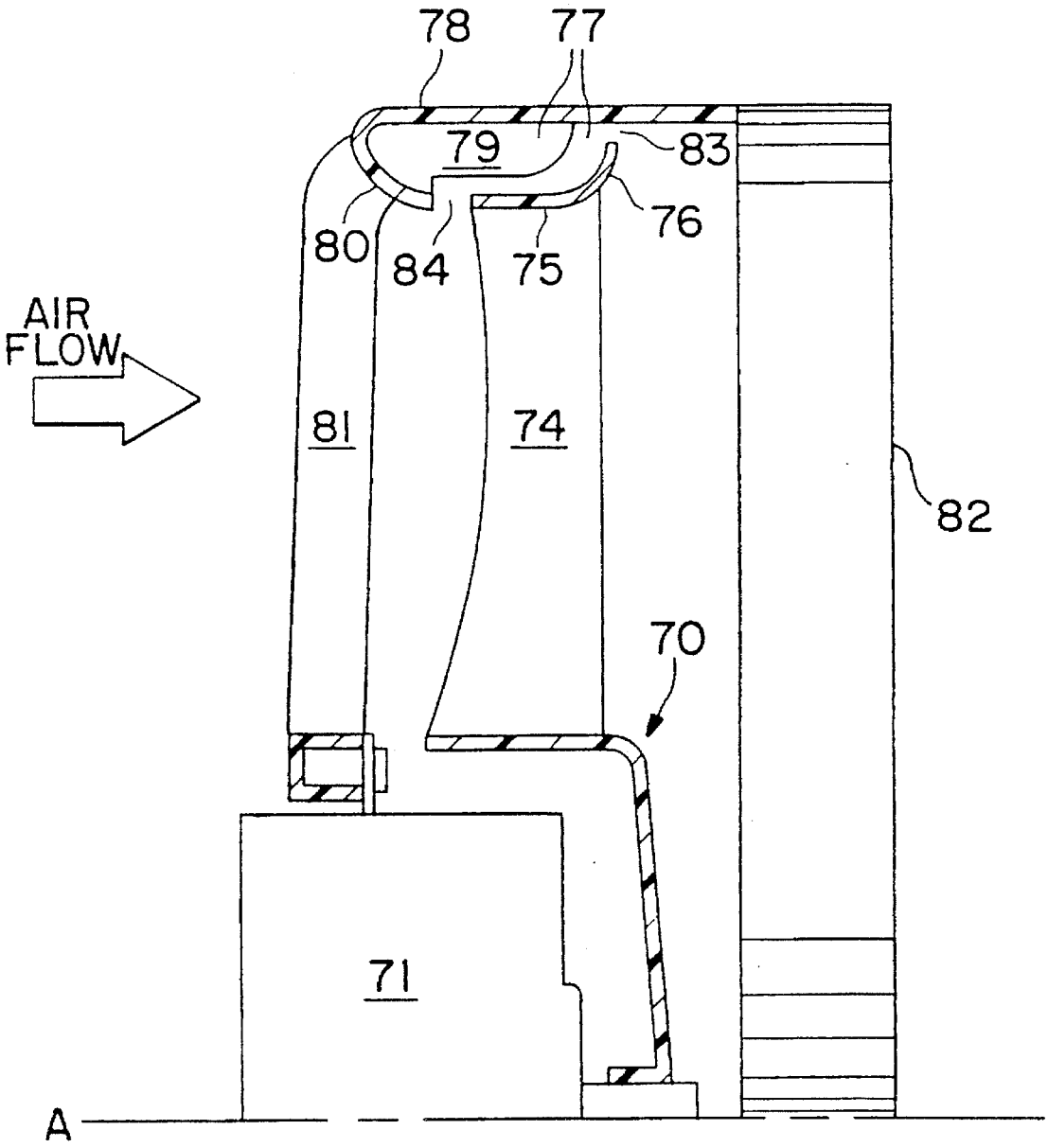

FIGS. 5A and 5B show two alternative fan and housing configurations in which the fan is upstream of the heat exchanger, and the shroud guides airflow (shown generally with an arrow) from the fan into the heat exchanger. In FIG. 5A, fan blade 54 has a band 55 with a lip 56 that forms an inlet to the fan. Airflow recirculation takes place through inlet 67 into space 57 between the shroud 58 and the band 55, and exits outlet 68. Vanes 59 are positioned in space 57 to encounter recirculating airflow and reduce swirl in the recirculating airflow. Fan motor 65 is positioned between the fan and the heat exchanger 62. Shroud 58 includes a segment 60 to which motor supports 61 are attached.

In FIG. 5B, fan 70 blows air into downstream heat exchanger 82. Unlike the assembly of FIG. 5A, motor 71 of the assembly of FIG. 5B is upstream of the fan. The fan band 75 has a lip 76 on the downstream side, and the inlet to the fan is formed by a shroud segment 80 which curves inwardly and back toward heat exchanger 82. The motor 71 is attached to support 81. Recirculating airflow moves through inlet 83 to space 77 between band 75 and shroud 78, and exits outlet 84. Vanes 79 are positioned in space 77 to encounter that recirculating airflow and to reduce swirl in it. In this configuration, the inlet restriction upstream of the vanes and the vane shaping referenced below may be beneficial.

Figure 6:
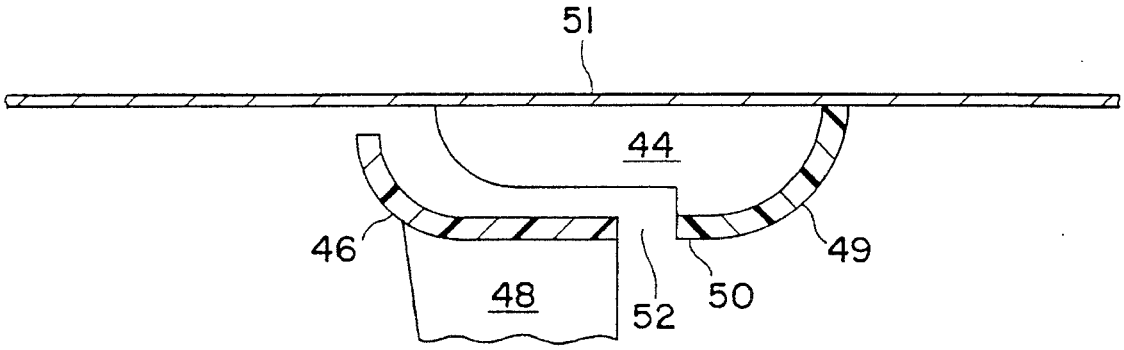
FIG. 6 is a diagrammatic representation of a fan and duct combination according to the invention.

FIG. 6 is a section showing a variation of the invention useful in ducted fans. The vanes 44 are provided as a separately molded part having a flared rear face 49 which terminates in an edge 50 that forms the inlet 52 for the recirculation flow path. In other respects, the blades 48, the band 46 and the duct 51 are similar to those described below.

Figure 7:
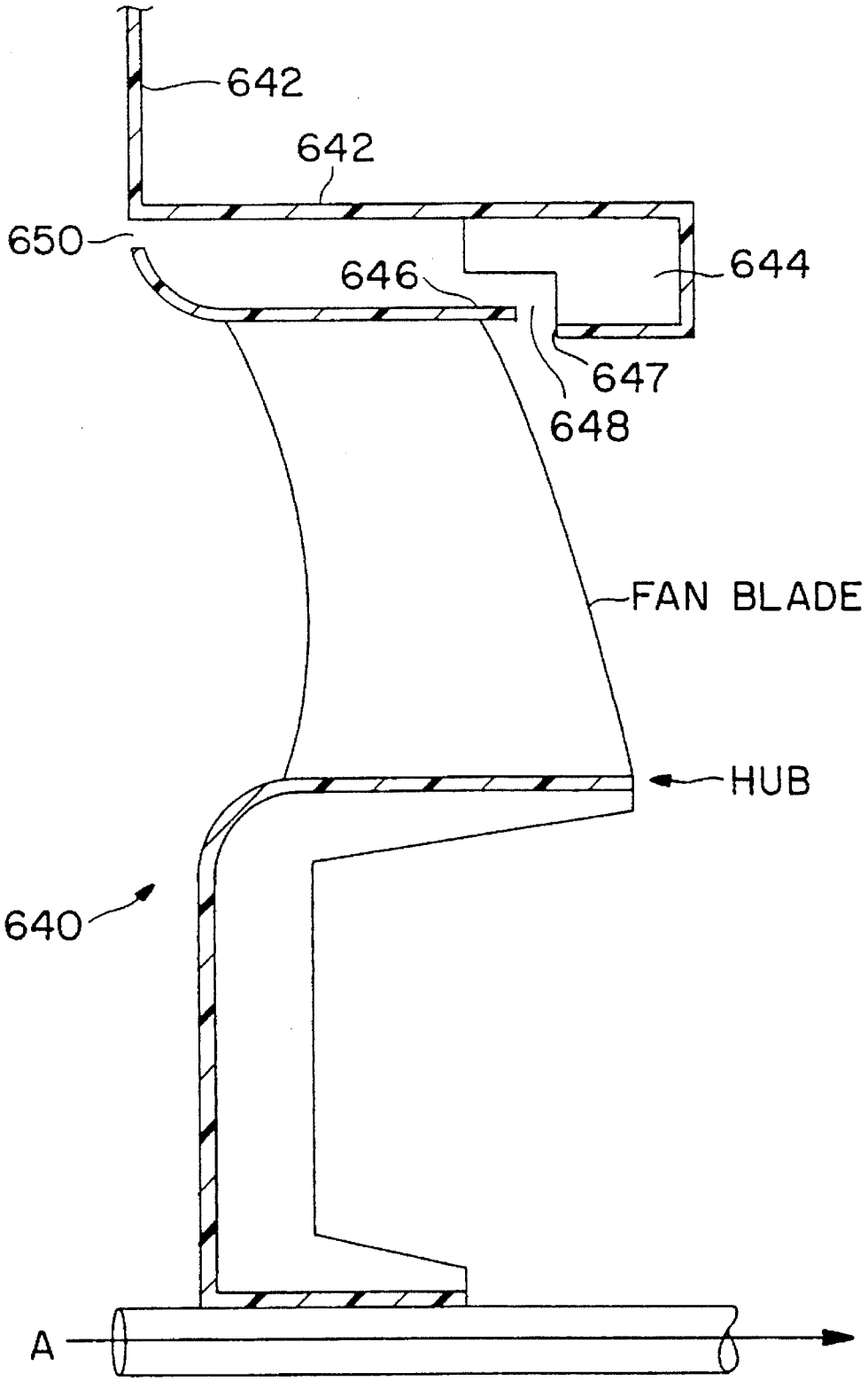
FIGS. 7–9 are side views in section of other fan and housing combinations.

FIG. 7 shows a fan 640 housed in a shroud 642 which guides airflow through a radiator (not shown) upstream of the fan. Vanes 644 are L-shaped in this view and radial in a plane perpendicular to the fan axis. Lip 646 forms a restriction inlet 648 with lip 647. The vanes are spaced from ⅛ to ½ of an inch apart-around the circumference, with the smaller spacing being used in very small fans.

The fan and housing combination of FIG. 7 can also be used (with some modification) as a ducted fan. In some applications, the width of the recirculation outlet is at least twice the width of the recirculation inlet. Increasing the width of outlet reduces the velocity of the leakage flow thus reducing flow disruption as the recirculation flow enters the main flow.

Figure 8:
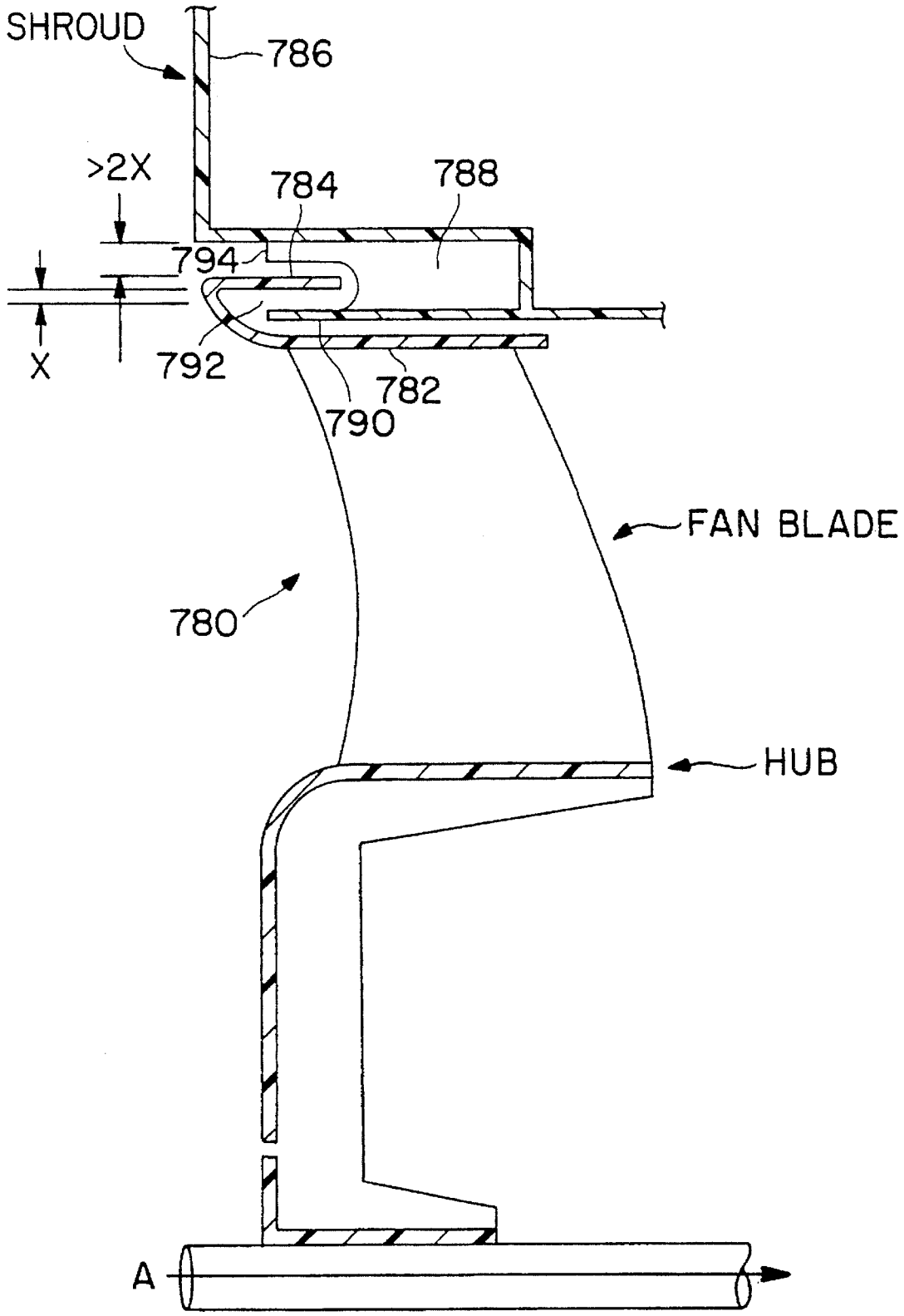

In FIG. 8, fan 780 has a band 782 with an upstream edge that turns back axially to form lip 784. Shroud 786 includes vanes 788. A lip 790 on shroud 786 forms a restriction 792 in the recirculation path, which feeds the airflow to vanes 788 and from there to outlet 794. In this particular embodiment, the outlet to the recirculation path is at least twice as wide as the restriction.

Figure 9:
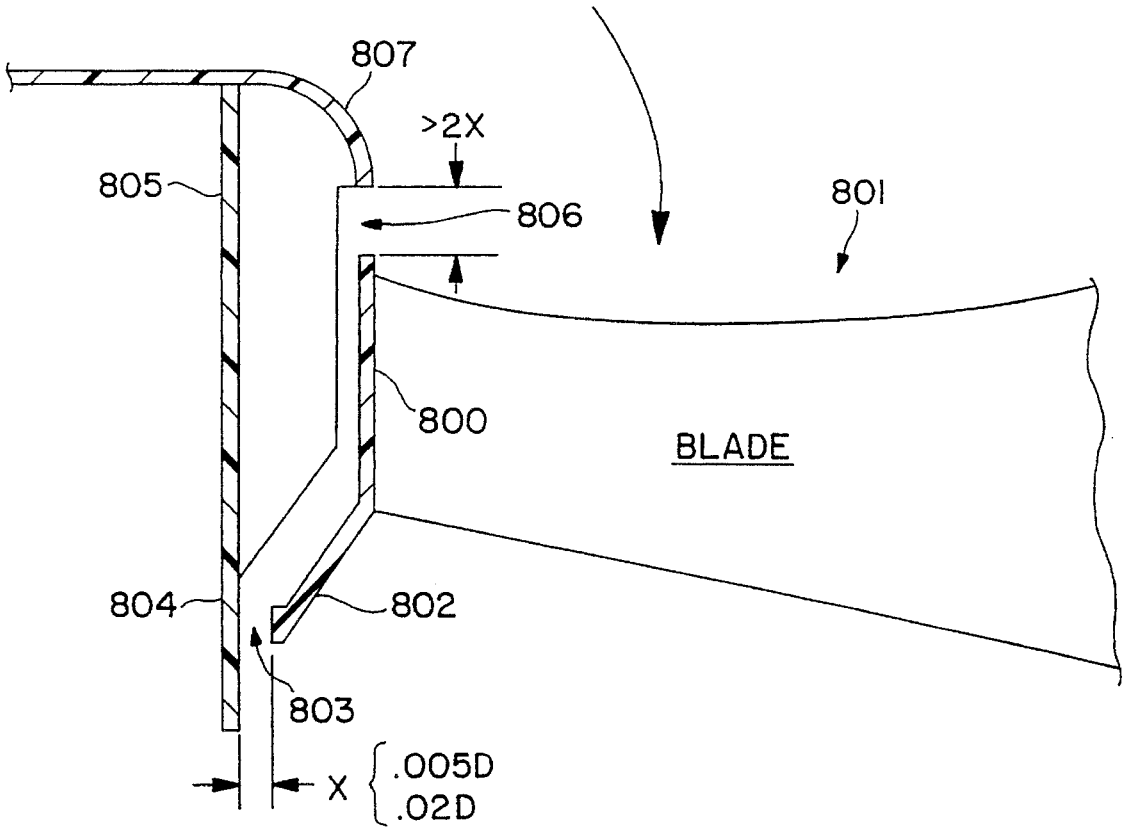

In FIG. 9, band 800 of fan 801 has a trailing lip 802 which forms restriction 803 with shroud 804. Leakage vanes 805 extend from shroud 804. Bell mouth 807 together with the axially forward edge of band 800 form outlet 806 to the recirculation path.

II. Vanes Upstream of the Fan Band

FIG. 10 depicts a fan 90 in which the housing 92 is a duct or shroud having vanes 94 upstream of band 96. Inlet 91 is formed between the upstream edge of band 96 and duct 92. This inlet ("X") is on the order of 0.005 D–0.02 D. Recirculation airflow is entrained into vanes 94 and leaves through the open sides 98 of the slots between vanes 94.

With reference to FIGS. 11–15, in preferred embodiments the array of vanes is provided by a dual ring structure 217 which fits within the duct 212 just upstream of the fan 214. The vane assembly may be made from molded plastic, hard plastic foam, or any suitable material which may be fashioned into the requisite geometry. As shown in FIG. 11, the assembly consists of an outer ring 216, an inner ring 218, and a plurality of vanes 220 disposed generally radially between the two rings 216, 218.

Although use of an inner ring 218 is not absolutely necessary, it is preferred. The ring 218 gives structural rigidity to the assembly. This is beneficial if it is desired to form the housing by wrapping sheet metal, or some other flexible material, around the perimeter of the outer ring 216 to form the duct.

The inner ring 218 also divides the duct into separate flow passageways, an inner primary passageway 222 through which the primary flow passes, and an outer, annular recirculation passageway 224 through which the recirculation flow passes. The inner ring 218 helps to inhibit radial flow, where it exists, from reentering the fan.

As disclosed above, it is advantageous to use a banded fan 214 in which the band 226 terminates in a curved lip 228. The curved lip 228 forms a restriction 230 in the recirculation passageway 224.

As shown in FIG. 13A and 14A, the vanes 220 may be substantially flat, non-shaped vanes. Such vanes generally may provide adequate performance. As explained below, however, for other applications (e.g., low pressure rise fans or fans that are designed both for high and low pressure rise) additional vane shaping can improve performance.

Without wishing to bind ourselves to a single, specific theory as to the operation of such shaping improvements, it appears that the tangential velocity of the recirculation flow is induced mainly by viscous effects, and is therefore approximately a fixed percentage of tip speed. The axial velocity, however, is caused by the pressure difference across the fan. As a result, a fan which generates a relatively low pressure (for its diameter and rotation speed) will have a recirculation flow which approaches the vane at an angle closer to tangential than will be the case for a relatively high pressure fan. When air approaches a vane with a square end face (FIG. 14A) at an angle close to tangential, there is a tendency for some of this flow to be deflected in the tangential and inward radial directions, rather than to pass through the space between the vanes. In this case, it is beneficial to provide some additional shaping to the vanes.

Tangential deflection of airflow is reduced by bevelling the end face 234 of each of the vanes 220, as shown in FIG. 14B. The end face 234 is beveled such that the high pressure side surface 236 of the vane projects further upstream (taken from the perspective of the recirculation flow) than the low pressure side surface 238. The bevel angle, β, can be at least 20°, and is preferably 30° or more.

Deflection of flow in the inward radial direction is reduced by incorporating additional detailed vane shaping in two respects. First, as shown in FIG. 14B, the high pressure side surface 236 is made concave by the addition of a cylindrical region 242 at the leading edge 250, i.e., the juncture of the high pressure side surface 236 and end face 234. The radius of curvature r of the cylindrical region 242 can be on the same order as ½ of the spacing between vanes.

Secondly, the vanes can be non-radial in a section perpendicular to a plane normal to the fan axis. In FIG. 13B, the innermost tips 250 of the vanes 220 are inclined into the impinging recirculation flow. The lean angle, λ, should preferably be between 3° and 10° from radial. Alternatively, as shown in FIG. 13C, vanes (or at least the high pressure side of the vanes) of some embodiments are slightly cylindrical in a plane normal to the fan axis. The center of curvature is parallel with the fan centerline and is placed on a tangent to the outside periphery of the vane. The radius of curvature is approximately 20% of the fan diameter. The vanes are radial at the outer periphery of the device, and are more inclined toward the flow as radius decreases.

FIG. 15 is a perspective view of a portion of a dual ring structure 217 looking axially toward the rear face 232 of vanes 240. As described above, the leading edge 242 of vanes 220 is beveled, and the high pressure side face 236 is shaped. The vanes are slightly cylindrical in a plane normal to the fan axis.

Other embodiments are within the following claims. For example, the above described vanes can be used with fan/shroud combinations that blow air through a downstream heat exchanger. Specifically, they can be used with the fan/shroud combinations as generally described in a commonly owned U.S. Patent Application titled Fan Inlet With Curved Lip And Cylindrical Member Forming Labyrinth Seal, filed on Jun. 17, 1993, by Michael Sortor, and given serial number 08/079,317. That application is hereby incorporated by reference.

What is claimed is:

1. A fan and housing combination comprising a fan having a hub that rotates on an axis and blades extending outwardly from the hub to a circular band that connects the blade tips, the combination also comprising a housing surrounding the fan to control airflow the combination being characterized in that:

a) a portion of the housing is positioned outward of the fan band and there are running clearances between the band and the housing such that recirculating airflow moves in a pathway between the fan and the housing; and b) stationary flow control vanes are connected to the housing in a position to encounter and redirect recirculating airflow.

2. The fan and housing combination of claim 1 in which the fan is positioned downstream of a heat exchanger, whereby the fan draws air through the heat exchanger.

3. The fan and housing combination of claim 1 in which the housing is positioned upstream from a heat exchanger, whereby the fan pushes air through the heat exchanger.

4. The fan and housing combination of claim 1 in which the housing is a duct.

5. The fan and housing combination of claim 1 in which the housing and the vanes are a single injection molded plastic unit.

6. The fan and housing combination of claim 1 characterized by a radial fan-to-housing clearance of at least 0.25% of the fan diameter.

7. The fan and housing combination of claim 1 characterized in that an airflow recirculation pathway is formed between the fan band and the housing, and at least a portion of the vanes is positioned in the pathway.

8. The fan and housing combination of claim 1 or claim 7 in which the housing is characterized by a reduction in radius at a location rearward of the trailing edge of the fan band.

9. The fan and housing combination of claim 8 in which the pathway has an inlet formed between the fan band and the housing, and at least a portion of the vanes is positioned radially outward of the pathway inlet.

10. The fan and housing combination of claim 9 in which the radially innermost face of the vanes is rounded.

11. The fan and housing combination of claim 8 in which the housing radius reduction reduces the housing inner radius to $R_r$, such that $R_r<C+R_b$, where $R_b$ is the outer radius of the trailing edge of the fan band, and C is the radial fan-to-housing clearance.

12. The fan and housing combination of claim 8 in which the housing radius reduction reduces the housing inner radius to a radius that is approximately equal to or less than the outer radius of the trailing edge of the fan band.

13. The fan and housing combination of claim 12 in which the housing radius reduction reduces the housing radius to a radius that is less than the outer radius of the trailing edge of the fan band.

14. The fan and housing combination of claim 8 in which the housing comprises a rearward housing segment extending from the radius reduction rearwardly to rearward housing terminus.

15. The fan and housing combination of claim 14 in which the housing comprises elongated motor supports which extend from the rearward housing segment to a centrally positioned motor mount.

16. The fan and housing combination of claim 14 in which, as the housing extends rearwardly from the location of the radius reduction, the inside diameter of the housing increases.

17. The fan and housing assembly of claim 16 in which, as the housing extends rearwardly from the location of the radius reduction, the thickness of the housing decreases.

18. The fan and housing combination of claim 8 in which an inlet to the pathway is formed between the housing and the trailing edge of the band, and the shroud comprises a portion which extends first rearwardly and then inwardly and forwardly, forming a pocket axially rearward of the inlet.

19. The fan and housing combination of clam 18 in which at least a portion of the vanes extends into the pocket.

20. The fan and housing combination of claim 8 in which at least a portion of the vanes is axially rearward of the trailing edge of the band, and the vanes are characterized by a reduction in radius at a position axially rearward of the trailing edge of the fan band.

21. The fan and housing combination of claim 1 or claim 7 in which the recirculating airflow pathway includes an outlet formed between the housing and an outwardly flaring segment of the leading edge of the fan band.

22. The fan and housing combination of claim 1 in which the vanes are straight taken in a section in a plane normal to the fan axis.

23. The fan and housing combination of claim 22 in which the vanes are non-radial taken in a section in a plane normal to the fan axis.

24. The fan and housing combination of claim 22 in which the vanes are radial taken in a section in a plane normal to the fan axis.

25. The fan and housing combination of claim 1 in which the vanes are curved taken in a section in a plane normal to the fan axis.

26. The fan and housing combination of claim 1 characterized in that the vanes are positioned at least in part upstream of the fan band.

27. The fan and housing combination of claim 1 in which said vanes are all part a single injection molded plastic assembly.

28. The fan and housing combination of claim 1 in which said airflow recirculation pathway comprises a restriction upstream (from the perspective of recirculating airflow) of the vanes.

29. The fan and housing combination of claim 28 wherein the cross-sectional area of said pathway at said restriction is less than ½ the cross-sectional area of the outlet to said pathway.

30. The fan and housing combination of claim 28 wherein said band comprises a lip extending from the band to establish the restriction between the lip and the housing.

31. The fan and housing of claim 26 in which the vanes are positioned entirely upstream of the fan band.

32. The fan and housing combination of claim 1 or claim 26 wherein said vanes have a beveled end face.

33. The fan and housing combination of claim 32 wherein the end faces of said vanes are beveled by at least 20°.

34. The fan and housing combination of claim 26 wherein said vanes are arranged in an array whose inward tips are connected by an inner ring.

35. The fan and housing combination of claim 32 in which the high pressure side of the vanes has a concave portion adjacent to the end face of the vanes.

36. The fan and housing combination of claim 35 in which the radius of said concave portion is between 0.1 S and 1.0 S, where S is the spacing between adjacent vanes.

37. The fan and housing combination of claim 35 in which the high pressure side of said vanes is curved in a plane normal to the fan axis.

38. The fan and housing combination of claim 37 in which the high pressure side of said vanes is substantially cylindrical in a plane normal to the fan axis, having a radius of curvature between 0.15 D and 0.3 D, where D is the fan diameter.

39. The fan and housing combination of claim 34 in which:

a) the end faces of said vanes are beveled by at least 20°;

b) the high pressure side of the vanes has a concave portion adjacent to the end face of the vanes, having a radius of curvature of between 0.1 S and 1.0 S, where S is the spacing between adjacent vanes; and c) the high pressure side of the vanes is substantially cylindrical in section in a plane normal to the fan axis, having a radius of curvature of between 0.15 D and 0.3 D, where D is the fan diameter.

40. The fan and housing combination of claim 18 in which elongated motor supports extend radially inwardly from said shroud portion to a centrally positioned motor mount.

41. The fan and housing combination of claim 9 in which the radially innermost face of the vanes is beveled.

42. A combination axial flow automotive fan and housing, said fan having a hub that rotates on an axis and blades extending outwardly from the hub to a circular band that connects the blade tips, the combination also comprising a housing surrounding the fan to control airflow, the combination being characterized in that:

a) a portion of the housing is positioned outward of the fan band and there are running clearances between the band and the housing such that recirculating airflow moves in a pathway between the fan and the housing; and b) stationary flow control vanes are connected to the housing in a position to encounter and redirect recirculating airflow.

* * * * *

UNITED STATES PATENT AND TRADEMARK OFFICE

CERTIFICATE OF CORRECTION

PATENT NO. : 5,489,186

DATED : February 6, 1996

INVENTOR(S) : Martin G. Yapp et al

It is certified that error appears in the above-identified patent and that said Letters Patent is hereby corrected as shown below:

In the References Cited Section, U.S. Documents, Lariviere date should be 3/1970
Patent number 4,448,573 "Iranz" should be --Franz--

Col. 1, line 34, "a" should be --as--
Col. 4, line 7, "30" should be --30°--
line 54, "FIGS." should be --FIG.--
line 57, after "vanes." start a new paragraph
lines 58-59, "FIG. 12" should be moved
Col. 5, line 6, after "Band" start a new paragraph
Col. 6, line 7, "FIGS." should be --FIG.--
Col. 7, line 6, "apart-around" should be --apart around--
Col. 8, claim 1, line 64, after "airflow" insert a comma
Col. 10, claim 19, line 1, "clam" should be --claim--

Signed and Sealed this

Twenty-sixth Day of November 1996

*Attest:*

Bruce Lehman

BRUCE LEHMAN

*Attesting Officer*

*Commissioner of Patents and Trademarks*